United States Patent [19]

Palmer et al.

[11] Patent Number: 4,631,775

[45] Date of Patent: Dec. 30, 1986

[54] HIGH SPEED FLOOR BURNISHER

[75] Inventors: Gary E. Palmer, Roselle, Ill.; Mike J. Todd, Eagan, Minn.

[73] Assignee: Hako Minuteman, Inc., Addison, Ill.

[21] Appl. No.: 787,269

[22] Filed: Oct. 15, 1985

[51] Int. Cl.[4] ..... B24B 29/00; A47L 11/14; A47L 11/20

[52] U.S. Cl. ..... 15/385; 15/98; 15/230.17

[58] Field of Search ..... 15/98, 230, 230.14, 15/230.15, 230.16, 230.17, 230.18, 230.19, 385

[56] References Cited

U.S. PATENT DOCUMENTS

| | | | |
|---|---|---|---|
| 3,067,549 | 12/1962 | Laverdisse | 15/230.17 |
| 3,386,122 | 6/1968 | Mathison | 15/230.17 |
| 4,485,519 | 12/1984 | Collier | 15/385 |
| 4,541,207 | 9/1985 | Antonson | 15/230.17 X |

*Primary Examiner*—Edward L. Roberts

*Attorney, Agent, or Firm*—Emrich & Dithmar

[57] ABSTRACT

A driver assembly for the pad of a high speed floor burnishing machine includes a flexible backing plate having a peripheral retaining skirt which centers the pad on the driver assembly and also prevents the edges of the pad from growing or expanding to a larger circumference during high speed rotary burnishing action. The backing plate adds stiffness to the pad when rotating at high speed, and it promotes uniform contact of the pad with the floor at the outer radial extremities of the pad where the velocity is greatest and the polishing is most effective. In the illustrated embodiment, the pad and driver assembly are surrounded by a shroud which is continuously evacuated by radial air flow generated by the motion of the driver assembly which includes a finned hub. The air flow carries debris generated by the burnisher to a collection bag or filter without leaving the machine.

11 Claims, 4 Drawing Figures

FIG. 3
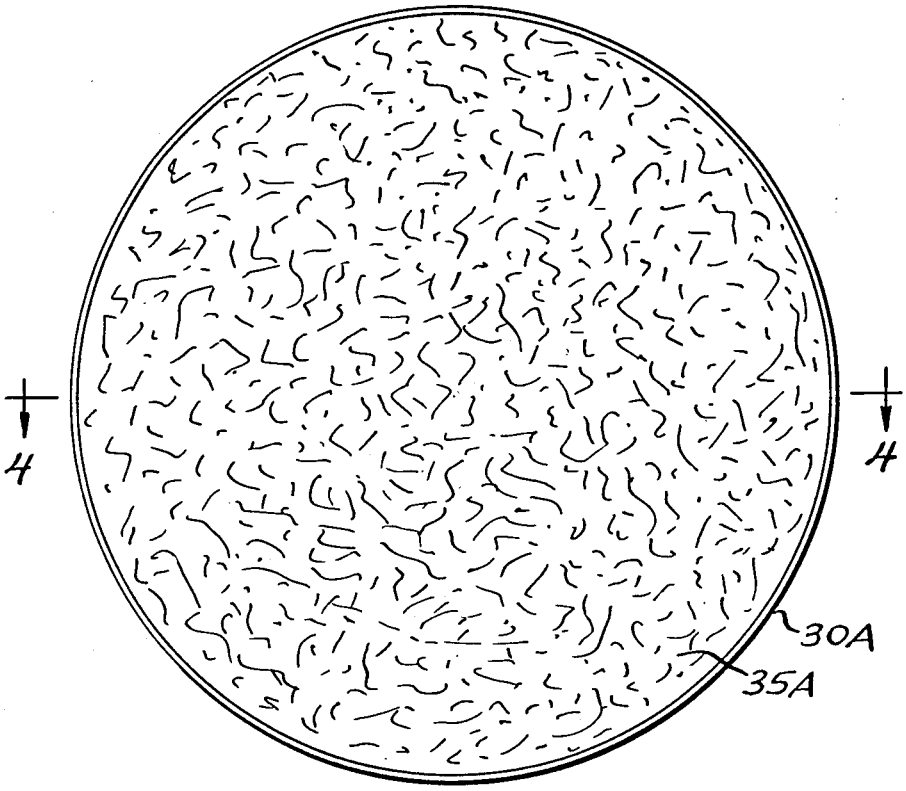
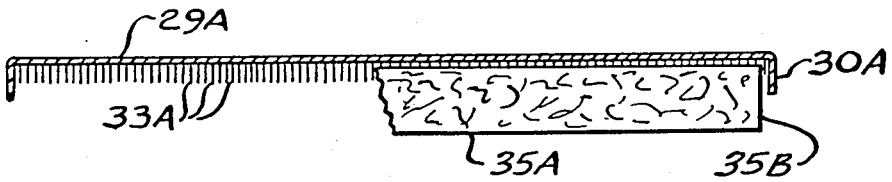
FIG. 4

HIGH SPEED FLOOR BURNISHER

BACKGROUND AND FIELD OF THE INVENTION

The present invention relates to floor polishers or burnishers; and more particularly, it relates to so-called high speed burnishers. As used here, "high speed" refers to rotary burnishing machines wherein the floor-contacting pad is rotated at an angular velocity greater than 1,000 revolutions per minute. Typically, such machines may operate at speeds up to 1,800 or 2,000 RPM.

Modern floor burnishers operating at high speeds of the range with which the present invention is concerned have a number of problems. Typically, the polishing pad is made of synthetic or natural fiber wherein the fibers are very loosely woven together. Adhesive or physical interconnection may be used to connect the fibers, but there is nevertheless a tendency for the cirumference of the pad to creep or "grow" during use. This problem is even more pronounced at higher operating speeds such as 2,000 RPM; and the result is a thinning of the pad resulting in a greatly accelerated wear and corresponding reduced life of the pad.

There are at least two different types of burnishing action in high speed machines (both of which experience the problem of pad expansion mentioned above). In one type of burnisher, the axis of rotation of the pad is slightly off the vertical so that the pad contacts the floor at a slight incline. Pressure is greater at the lowest point of the pad, which is on the periphery at one point, but the diametrically opposite point of the pad has little or no contact with the floor. Burnishing is achieved in the area of forced contact, and the downward force on the pad is chiefly provided by the weight of the machine. Another type of burnisher relies on full circumferential contact between the pad and floor and the downward force is substantially uniform in the entire contact area which is annular in shape. In this type of machine, contact is achieved because the pad is highly porous and the high rotary speed evacuates air from the pad under centrifugal force. The air is forced outwardly thereby evacuating the pad, and atmospheric pressure acts uniformly downwardly on the pad driver bringing the entire pad driver (which ideally rotates about a true vertical axis) downward forcing the pad into full circumferential engagement with the floor. This type of machine (which we refer to here as a "full contact" type) is believed to be more advantageous because the maximum load current drawn from a conventional wall outlet is limited under normal use conditions and because a high luster can be achieved.

In the latter type of machine, however, the weight of the machine can actually be a disadvantage unless some special provision such as a center caster is incorporated into the machine because there is a tendency to cause the outer edges of the pad to curl up and lose their ability to burnish effectively. A rigid back plate does not solve this problem satisfactorily because then the pad drive cannot follow variations in floor contour. Flexibility to the driver assembly is desirable.

Still another problem associated with high speed floor burnishers is that operation of the burnisher generates dust which, if not collected, rapidly spreads throughout the area being conditioned, and the dust quickly will cover desks or other furniture in the area.

SUMMARY OF THE INVENTION

The present invention is directed to a driver assembly for the pad of a high speed floor burnisher. It is particularly useful in the "full contact" type of burnisher described above because it is flexible yet does not curl up at the edges. The driver assembly includes a central hub for attaching to the shaft of the drive motor, and a flexible backing plate attached to the hub. The backing plate has a peripheral retainer skirt which extends downwardly and retains the outer circumferential surface of the polishing pad.

The backing plate is made of a material, such as ABS plastic which adds stiffness and support to the pad but does not make it absolutely rigid. The pad is thus able to continue to conform to the contour of the surface being burnished during operation. Yet, the stiffness of the backing plate, particularly when rotating at high speeds, creates a uniform downward pressure at the outer edges of the pad where the speed of the pad is highest, and thus, where the polishing effect is greatest. This is particularly helpful in enhancing the end result in machines of the "full contact" type.

When the driver and pad are operated at high speed, the retaining flange on the backing plate engages the outer circumferential surface of the pad and prevents it from growing or creeping outwardly in use, thereby increasing significantly the life of the pad.

Because the desired contact pattern is achieved by the backing plate, special supports such as the center caster can be eliminated and the pad can be made as a continuous disc without the center removed, as we will show.

The driver assembly of the illustrated embodiment is surrounded by a vacuum shroud which is suspended from the frame of the machine but permitted to float independently of the pad and driver assembly. The hub of the driver assembly has radially extending fins to generate an outward air flow pattern when the driver assembly is set in motion.

The vacuum shroud is provided with an air inlet opening so that the outward air pattern generated by the rotating hub is continuous and creates an air flow pattern over the top of the driver assembly and thence downwardly over the sides of the pad where any dust created by the high speed operation of the pad becomes entrained in the air flow. The air flow continues through a discharge aperture and a flexible conduit into a dust collection container in the machine, rather than being distributed into the atmosphere as free-floating dust particles.

Other features and improvements of the present invention will be apparent to persons skilled in the art from the following detailed description of a preferred embodiment accompanied by the attached drawing wherein identical reference numerals will refer to like parts in the various views.

BRIEF DESCRIPTION OF THE DRAWING

FIG. 3 is a bottom view of a modified pad and gripper incorporating the invention; and FIG. 4 is a sectioned view of the alternate pad and gripper shown in FIG. 3 with portions of the pad removed for clarity.

DETAILED DESCRIPTION

Figure 1:
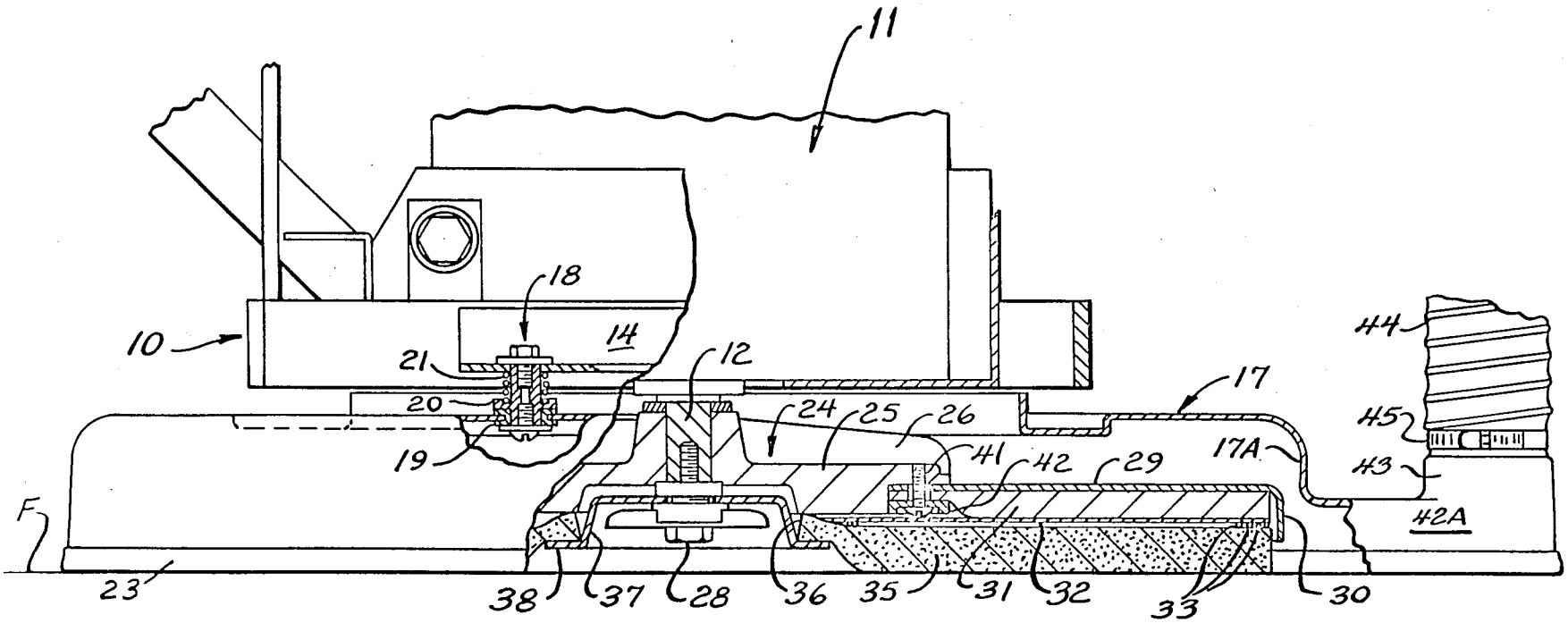
FIG. 1 is a side elevational view of the vacuum shroud and driver assembly of a burnishing machine constructed according to the present invention with portions of the shroud broken away and the driver assembly shown in cross-section.

Referring first to FIG. 1, reference numeral 10 generally designates a suspension frame which is mounted front and rear to a wheeled carriage (not shown). The carriage is conventional and forms no part of the instant invention. The carriage may include cover panels so that the apparatus seen in the drawing is not normally seen. A motor 11 is carried by the frame 10 and includes a shaft 12 for defining a substantially vertical drive axis perpendicular to the floor illustrated at F.

Figure 2:
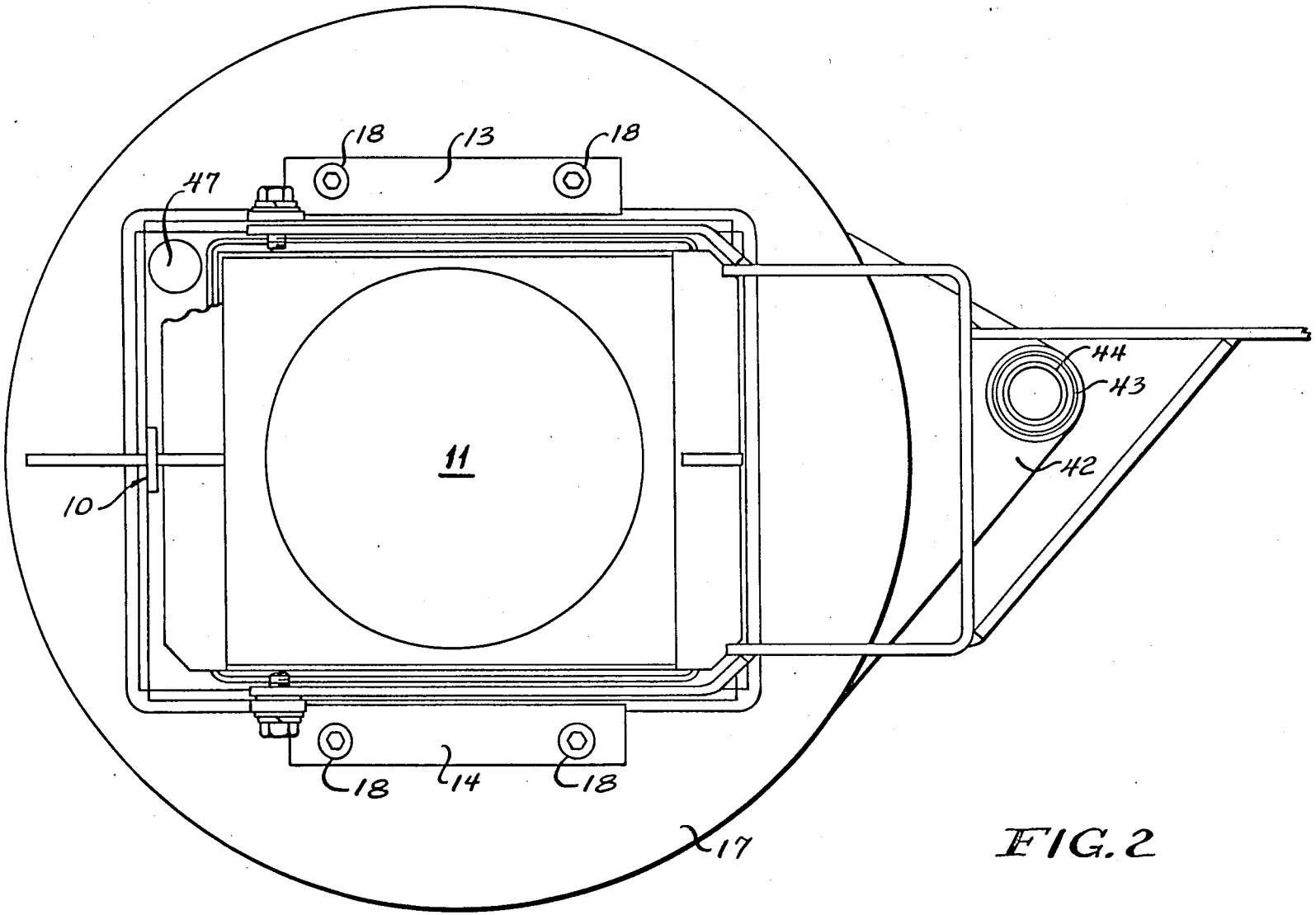
FIG. 2 is a top view of the apparatus seen in FIG. 1.

As best seen in FIG. 2, a pair of side mounting brackets 13, 14 in the form of angle irons are mounted to the frame 10 and provide horizontal flanges for mounting a vacuum shroud generally designated 17. The vacuum shroud 17 is mounted to the brackets 13, 14 by four spring mounts 18, two on either side of the motor 11.

As best seen in FIG. 2, each of the spring mounts includes a grommet 19 received in a hole in the top wall of the vacuum shroud 17. A spring retainer member 20 is received in the grommet 19 and extends upwardly where a coil spring 21 is compressed between the spring retainer 20 and the horizontal mounting flange 14 to urge the vacuum shroud downwardly. The retainer is held in place by screws. The mounting bracket 14 is free to ride over the spring retainer and compress the spring so that the vacuum shroud is mounted to the frame 10 for independent motion relative to the frame. A flexible lip 23 is fitted over the bottom edge of the shroud 17 for sealing the shroud to the floor.

Within the vacuum shroud 17 and mounted to the drive shaft 12 of the motor 11 is a pad drive assembly generally designated 24. The drive assembly 24 includes a central hub 25 having a plurality of radially extending fins or ribs 26. The hub 25 has a central aperture for receiving the shaft 12; and the hub is secured to the shaft by means of a bolt 28. The hub 24 may be of cast metal.

A flexible backing plate 29 extends outwardly of the hub 24, and its periphery is formed downwardly at 30 to provide a retaining flange or skirt. Beneath the backing plate 29 is a rubber backing 31. Beneath the rubber backing 31 is a gripping face 32, the lower surface of which is provided with a plurality of gripping members in the form of hooks, some of which are seen at 33, although the gripping members 33 are located uniformly throughout the lower surface of the gripping face 32.

Beneath the gripping face 32 and held by the gripping members 33 is a polishing pad 35.

In the embodiment illustrated in FIG. 1, the center portion of the pad is removed as at 36 to receive a retainer cup 37 which has an outwardly extending flange 38 which fits under the inner portion of the pad 35. The bolt 28 secures the retainer member 37 as well as the hub 24 to the drive shaft 12, and the flange 38 clamps the inner portion of the pad 35 to the hub.

The gripping face 32 is secured to the bottom surface of the rubber backing member 31 by adhesive; and the rubber backing 31 and backing plate 29 are secured to the periphery of the hub 24 by a plurality of screws such as that designated 41 in FIG. 1 and an annular clamping member 42 which extends completely around the inner edge of the rubber backing 31.

As seen best in FIG. 2, one end of the vacuum shroud 17 is formed into a lateral extension 42 and an upwardly extending discharge portion 43 which defines a discharge opening leading into a conduit 44. A conventional dust collection bag may be attached to the end of the conduit 44 for collecting dust, and the conduit 44 is secured to the discharge portion 43 of the vacuum shroud by a conventional hose clamp 45.

In operation, when the pad driver assembly is driven at high speed (that is, as mentioned, at an angular velocity greater than 1,000 RPM and typically in the range of 1,800–2,000 RPM), the backing plate 29 becomes even stiffer than it is at rest. For example, if the backing plate 29 is formed with a slight crown (that is it is inclined upwardly as proceeds radially inwardly), the backing plate can be observed to flatten out. This has the effect of not only increasing the resistence of the pad 35 to curling up at the outer peripheral edges, but it also has the effect of applying a more uniform distribution of downward force to the pad in the area where the speed of the pad is greatest and, therefore, the burnishing is most effective. This enhances a more uniform burnishing effect, and increases the downward pressure on the outer peripheral portions of the pad where the velocity of the pad is greatest, thereby enhancing burnishing action.

When the hub is rotated, the fins 26 create a radially outward air flow pattern. Make up air is provided to the center of the hub by means of the air inlet aperture 47 (FIG. 2) in the top wall of the vacuum shroud 17. This radial air flow pattern causes air to flow outwardly across and above the driver assembly beneath the top wall vacuum shroud 17 where it is forced downwardly by the side wall 17A of the shroud and into the exhaust extension 42. This air flow pattern thus entrains all dust or particles created by the high speed burnishing action, and these entrained particles are then forced under action of the air flow created by fins 26 through the discharge conduit 44 into a collection receptacle or filter so they do not enter the atmosphere.

The pad is dimensioned to fit snuggly against the retainer flange when the pad is new. The peripheral retainer flange acts to center the pad on a driver when the pad is initially installed. This overcomes a problem where centering of the pad is accomplished by fitting the center opening of the pad over a collar on the center driver assembly or by inserting a cup as shown. In some cases, the center opening of a replacement pad is not truly centered on the pad, and the resulting motion of the pad will not be balanced as is required in high speed machines of this type. In addition to the centering feature, the skirt performs the dual function of preventing the replacement pad from growing larger. In the past, a pad might expand as much as 1 inch after only a few minutes of operation and expansion would continue, although at a slower rate.

Preferably, best results are obtained if the retainer skirt extends to encompass at least one-half the depth of the pad under normal operating conditions (i.e., in full contact pads, after the pad is evacuated and atmospheric pressures cause the driver assembly to compress the pad).

An alternative embodiment of the driver assembly is shown in FIGS. 3 and 4. A backing plate 29A includes a peripheral retaining flange 30A. Retaining hooks 33A are formed integrally with the backing plate itself. For example, the hooks, backing plate and flange may be injection molded as an integral unit. Further, the pad 35A is continuous and does not have a center portion missing. In this case, the hub may be of a locking type not requiring a retaining bolt, and the hub is simply secured by bonding or high strength adhesive to the top surface of the backing plate 29A. This has the advantage of an even more uniform distribution of the downward force to the pad, and also has the advantage, as does the embodiment shown in FIGS. 1 and 2, that during high speed operation, the retaining flange 30A on the backing plate engages the outer surface (see 35B in FIG. 4) and restrains the pad against going any further.

Having thus disclosed in detail a preferred embodiment of the invention, persons skilled in the art will be able to modify certain of the structure which has been illustrated or substitute equivalent elements for those disclosed while continuing to practice the principle of the invention; and it is, therefore, intended that all such modifications and substitutions be covered as they are embraced within the spirit and scope of the appended claims.

We claim:

1. In a floor burnisher including a motor having a shaft rotating at high speed, an improved driver assembly comprising: a hub coupled to the shaft of said motor for rotation therewith; a flexible backing plate attached to said hub and extending radially outwardly thereof and defining an outer peripheral retainer flange extending downwardly therefrom; pad gripper means beneath the underside of said backing plate and attached to said hub for rotating therewith; and a burnishing pad engaging said gripper means and having an outboard edge immediately adjacent said retainer flange of said backing plate, said retainer flange at least partially encompassing said pad.

2. The apparatus of claim 1 wherein said retainer flange extends downwardly to encompass at least one-half the depth of said pad in operation.

3. The apparatus of claim 1 wherein said pad is characterized as having a continuous polishing surface without material removed from the center thereof.

4. The apparatus of claim 1 characterized in that said backing plate is flexible enough to permit said pad driver assembly to conform to normal contours in a floor being burnished yet rigid enough to uniformly distribute a downward force to the outer peripheral portions of said pad to prevent the outward edges of said pad from curling upwardly under the weight of said apparatus.

5. The apparatus of claim 1 further including a vacuum shroud suspended from the frame of said machine and encompassing said driver assembly, said hub further including radially extending fins above said backing plate for forcing air outwardly over said backing plate and downwardly within said shroud and over said retainer flange to pick up particles generated by burnishing action; and collection means for receiving said air and said entrained particles for filtering the particles therefrom.

6. The apparatus of claim 5 further comprising cushion mount means for mounting said vaccum shroud to said frame to permit said vacuum shroud to accomodate to variations in floor contour independently of said pad.

7. The apparatus of claim 6 further comprising an inlet air passage in said shroud for permitting make up air to flow to said fins for establishing said air flow pattern above said backing plate.

8. The apparatus of claim 7 wherein said shroud has an upper wall and said inlet air passage comprises a single opening located in said upper wall adjacent the periphery of said shroud.

9. The apparatus of claim 1, wherein said hub is coaxial with the motor shaft.

10. A high speed burnishing pad and driver assembly comprising: a flexible backing member having a generally circular horizontal shape and an integral depending retainer flange; pad gripping means disposed on the under surface of said backing plate; and a polishing pad engaged by said gripping means and having an outer edge located immediately inward of said retainer flange, said retainer flange acting to restrain the outward movement of the outer edge of said pad under high speed operation.

11. The driver assembly of claim 10 characterized in that said pad is continuous and does not have a center portion removed therefrom.

* * * * *